US007467950B2

(12) United States Patent
Fan

(10) Patent No.: US 7,467,950 B2
(45) Date of Patent: Dec. 23, 2008

(54) IC SOCKET

(75) Inventor: Chia-Wei Fan, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/825,892

(22) Filed: Jul. 9, 2007

(65) Prior Publication Data

US 2008/0009151 A1 Jan. 10, 2008

(51) Int. Cl.
*H01R 12/00* (2006.01)

(52) U.S. Cl. ..... 439/66; 439/71; 439/862

(58) Field of Classification Search ..... 439/66–74, 439/862

See application file for complete search history.

(56) References Cited

U.S. PATENT DOCUMENTS 4,648,666 A * 3/1987 Lovell ..... 439/71
4,664,458 A * 5/1987 Worth ..... 439/82
5,655,913 A * 8/1997 Castaneda et al. ..... 439/66
6,083,022 A * 7/2000 Walkup ..... 439/260
6,183,316 B1 * 2/2001 Morris ..... 439/862
6,227,869 B1 * 5/2001 Lin et al. ..... 439/66
6,532,654 B2 * 3/2003 Guerin et al. ..... 29/884
6,872,082 B2 * 3/2005 Hsu et al. ..... 439/66
2005/0112959 A1 * 5/2005 Lai ..... 439/862
2007/0298627 A1 * 12/2007 Fan ..... 439/71

* cited by examiner

*Primary Examiner*—Renee Luebke
*Assistant Examiner*—Larisa Tsukerman
(74) *Attorney, Agent, or Firm*—Wei Te Chung

(57) ABSTRACT

An IC socket includes a socket body (10) defining a plurality of passageways (102), and terminals (20) insertable into each of the passageways. A retention projection (1020) extends into the passageway. Each terminal includes a slot at a middle portion thereof for receiving the retention projection. The slot defines a closed boundary line for restricting the retention projection such that movement of the terminal along a length axis of the passageway is limited within a predetermined distance, thereby preventing the terminal from being removed therefrom.

20 Claims, 2 Drawing Sheets

1

IC SOCKET

BACKGROUND OF THE INVENTION

1. Field of the Invention

The present invention relates to an IC socket for electrically connecting an IC package with a printed circuit board.

2. Description of the Related Art

One type IC socket typically includes a socket body having a plurality of passageways extending therethrough, and a plurality of terminals insertable into the passageways with upper contact portions of the terminals extending out of a top surface of the socket body. Such a terminal is designed to have no retention barbs for securing the terminal in the passageway. Instead, a protect cover is utilized to hold the terminal in position. Specifically, the protect cover is engageably placed onto the socket body, with a plurality of holes dimensioned to secure the upper contact portions of the terminals while permitting the upper contact portions exposed to the outside for mating with respective contact pads of an IC package. The providence of the protect cover, however, will make the manufacturing of the IC socket really complicated with additional manufacturing cost.

SUMMARY OF THE INVENTION

An IC socket according to an embodiment of the present invention includes a socket body having a plurality of passageways, and terminals insertable into each of the passageways. The socket body defines a mating interface for facing an IC package, a mounting interface positionable adjacent a substrate, and the passageways extending from the mating interface toward the mounting interface. The passageway defines a length axis thereof. A retention projection extends into the passageway. Each of the terminals includes contact portions for engaging respective conductive elements of the IC package and the substrate, and a middle portion locatable between the contact portions. The middle portion includes a slot for receiving the retention projection. The slot defines a closed boundary line for restricting the retention projection such that movement of the terminal along the length axis of the passageway is limited within a predetermined distance, thereby preventing the terminal from being removed therefrom. Thus, no protect cover is needed to hold the terminal in position, thereby reducing the manufacturing cost of the IC socket.

Other features and advantages of the present invention will become more apparent to those skilled in the art upon examination of the following drawings and detailed description of preferred embodiments, in which:

DETAILED DESCRIPTION OF PREFERRED EMBODIMENT

Figure 1:
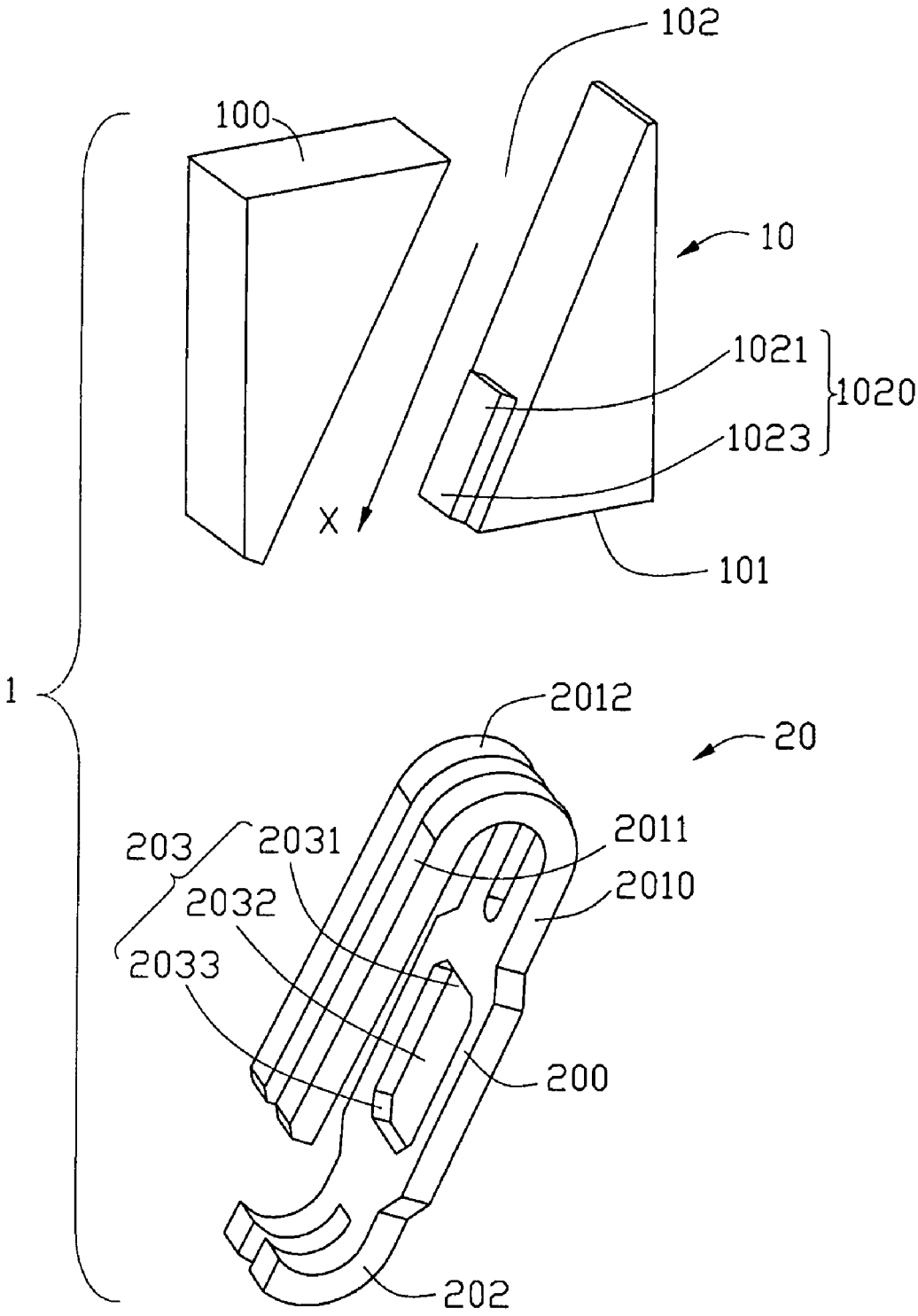
FIG. 1 is an exploded, perspective view of a part of an IC socket according to a preferred embodiment of the present invention.
Figure 2:
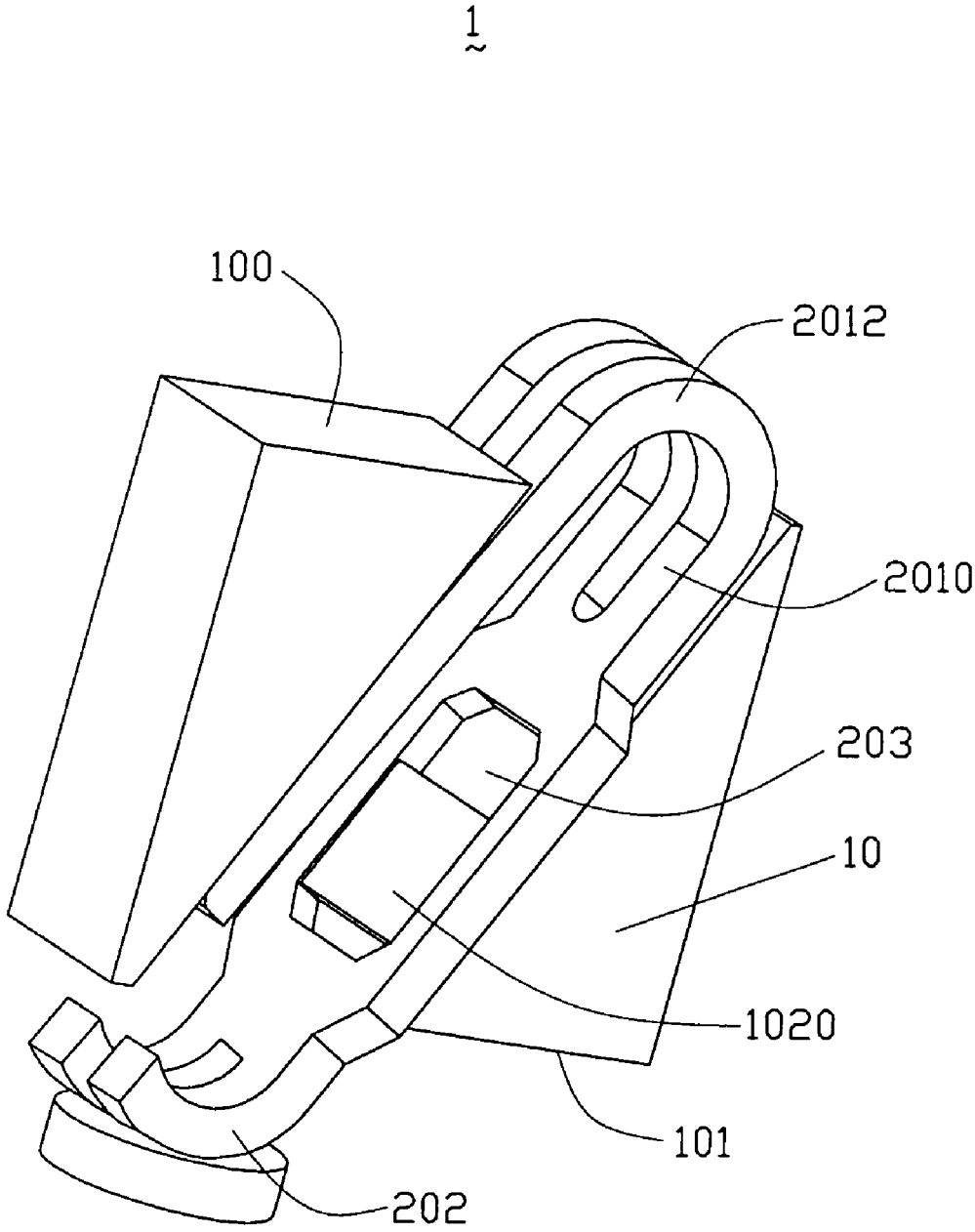
FIG. 2 is an assembled, perspective view of the IC socket of FIG. 1.

Referring to FIGS. 1 to 2, an IC socket 1 according to the preferred embodiment of the present invention is partly shown to include a socket body 10, and a plurality of terminals 20 inserted into the socket body 10.

The socket body 10 defines a mating interface 100 adapted for mating with one circuit board, such as an IC package (not shown), an opposite mounting interface 101 adapted for facing another circuit board, such as a printed circuit board (not shown), and a plurality of passageways 102 extending obliquely from the mating interface 100 toward the mounting interface 101. For the purpose of illustration, merely one passageway 102 is included herein. The passageway 102 defines a length axis 'X', along which the terminal 20 is movable within a predetermined distance (to be later described). A retention projection 1020 extends into the passageway 102 before the terminal 20 is fully inserted into the passageway 102. In this embodiment, the retention projection 1020 extends from a side wall of the passageway 102, and is of a rectangular shape. The retention projection 1020 defines two opposite projection ends 1021 and 1023.

Each terminal 20 is bent from a single sheet, and has double contact arms including a first resilient contact arm 2010 and a second resilient contact arm 2011 extending parallel to the length axis of the passageway 102. The terminal 20 is resiliently and engageably inserted into the passageway 102. More specifically, the first resilient contact arm 2010 and the second resilient contact arm 2011 are laterally and resiliently engagable with opposite side walls of the passageway 102 by a spring package contact portion 2012 formed at a joint of the first resilient contact arm 2010 and the second resilient contact arm 2011. The spring package contact portion 2012 of the terminal 20 is arranged to extend above the mating interface 100 for electrically mating with a conductive element of the IC package (not shown). The first resilient contact arm 2010 further includes a board contact portion 202 formed at a free end thereof and disposed opposite to the spring package contact portion 2012. The board contact portion 202 of the terminal 20 is arranged to extend below the mounting interface 101 for engaging with a conductive element of the printed circuit board (not shown). In this embodiment, each of the contact portions 2012 and 202 is provided with two contact regions divided by an aperture therebetween.

The terminal 20 further includes a middle portion 200 locatable between the spring package contact portion 2012 and the board contact portion 202, with its width thereof being larger than any of the contact portions 2012 and 202. The middle portion 200 includes an elongated slot 203 for receiving the retention projection 1020. The elongated slot 203 includes two opposite slot ends 2031 and 2033, and a middle slot section 2032 in correspondence with the retention projection 1020 for permitting the retention projection 1020 to be engageably moveable against two opposite side edges of the middle slot section 2032. Thereby, the elongated slot 203 defines a closed boundary line therebetween for restricting the retention projection 1020, with a maximum width of each slot end 2031 or 2033 at least not being larger than a minimum width of a corresponding projection end 1021 or 1023. This configuration of the elongated slot 203 allows the movement of the terminal 20 along the length axis of the passageway 102 to be limited with a predetermined distance, thereby preventing the terminal 20 from being removed therefrom. Thus, no protect cover is needed to hold the terminal 20 in position, thereby reducing the manufacturing cost of the IC socket 1.

Referring to FIG. 2, in assembly, the terminal 20 is insertable into the passageway 102 in a direction from the mounting interface 101 toward the mating interface 100. Due to the existence of the retention projection 1020 within the passageway 102, the double contact arms 2010 and 2011 of the terminal 20 are compressed to pass through the passageway 102 until the retention projection 1020 of the passageway 102 is received in the slot 203. The closed boundary line defined by the elongated slot 203 is configured to restrict the retention projection 1020 such that the movement of the terminal 20 along the length axis of the passageway 102 is limited within a predetermined distance.

While the present invention has been described with reference to preferred embodiments, the description of the invention is illustrative and is not to be construed as limiting the invention. Various of modifications to the present invention can be made to preferred embodiments by those skilled in the art without departing from the true spirit and scope of the invention as defined by the appended claims.

What is claimed is:

1. An IC socket comprising:

a socket body having a mating interface for facing an IC package, a mounting interface positionable adjacent a substrate, a plurality of slanted passageways extending from the mating interface toward the mounting interface, the passageway defining a slanted length axis thereof;

a retention projection extending into the passageway; and a terminal in each of the passageways, the terminal having contact portions for engaging respective conductive elements of the IC package and the substrate, and a middle portion locatable between the contact portions;

the middle portion having a slot for receiving the retention projection, said slot defining a closed boundary line for restricting the retention projection, the closed boundary line of said slot set such that said slot, along said slanted length axis of the passageway, has a space left for the retention projection to permit the contact moveable up-to-down relative to the passageway with a predetermined distance, while said slot, along a width direction perpendicular to said slanted length axis of the passageway, tightly engages the retention projection to limit movement of the contact relative to the passageway along said width direction.

2. The IC socket of claim 1, wherein the terminal includes double contact arms resiliently and engagably retained within the passageway.

3. The IC socket of claim 2, wherein said double contact arms extend parallel to said length axis of the passageway.

4. The IC socket of claim 2, wherein one of said contact portions is formed at a joint of said double contact arms.

5. The IC socket of claim 4, wherein another contact portion is formed at a free end of one contact arm opposite to said joint.

6. The IC socket of claim 5, wherein each contact portion is provided with two contact regions.

7. The IC socket of claim 1, wherein the retention projection includes opposite projection ends, the slot defines opposite slot ends spaced from the corresponding projection ends.

8. The IC socket of claim 1, wherein each passageway extends obliquely from the mating interface toward the mounting interface.

9. The IC socket of claim 1, wherein the middle portion has a width larger than that of any of the contact portions.

10. An IC socket comprising:

a socket body having a mating interface for facing an IC package, a mounting interface positionable adjacent a substrate, a plurality of passageways extending obliquely from the mating interface toward the mounting interface;

a retention projection extending into the passageway, the retention projection having opposite projection ends; and a terminal in each of the passageways, the terminal having contact portions for engaging respective conductive elements of the IC package and the substrate, and a middle portion locatable between the contact portions;

the middle portion having a closed-boundary slot for receiving the retention projection, the slot defining opposite slot ends, at least one of said slot ends spaced from the corresponding projection end such that the contact is moveable in an up-to-down direction relative to the passageway with a predetermined distance, while movement of the contact, along a front-to-back direction perpendicular to the up-to-down direction, relative to the passageway is prevented.

11. The IC socket of claim 10, wherein the terminal includes double contact arms resiliently and engagably retained within the passageway.

12. The IC socket of claim 11, wherein said double contact arms extend parallel to a length axis of the passageway.

13. The IC socket of claim 11, wherein one of said contact portions is formed at a joint of said double contact arms.

14. The IC socket of claim 13, wherein another contact portion is formed at a free end of one contact arm opposite to said joint.

15. The IC socket of claim 14, wherein each contact portion is provided with two contact regions.

16. An IC socket comprising:

a socket body having a mating interface for facing an IC package, a mounting interface positionable adjacent a substrate, a plurality of passageways extending from the mating interface toward the mounting interface;

a retention projection extending into the passageway; and a flexible terminal resiliently and engageably insertable into each of the passageways, the terminal having longer and shorter spring contact arms defining contact portions for engaging respective conductive elements of the IC package and the substrate, and a middle portion locatable between the contact portions;

the middle portion having an elongated slot for receiving the retention projection, said slot defining a closed boundary line and shaped such that said closed boundary line of said slot, along an up-to-down direction in which the contact is moveable relative to the passageway, is spaced with a distance from the retention projection.

17. The IC socket of claim 16, wherein the slot is essentially located at a lower level in the corresponding passageway, and the projection is essentially located at a lower level in the passageway.

18. The IC socket of claim 16, wherein the slot is fully hidden under the longer contact portion.

19. The IC socket of claim 16, wherein at least one of said longer contact portion and said shorter contact portion defines an axial slit to form two spaced contact section, and said axial slit does not communicate with said slot.

20. The IC socket of claim 16, wherein each passageway extends obliquely from the mating interface toward the mounting interface.

* * * * *